United States Patent [19]

Scranton et al.

[11] Patent Number: 4,645,195

[45] Date of Patent: Feb. 24, 1987

[54] SHEET-REGISTRATION AND FEEDING APPARATUS

[75] Inventors: Robert J. Scranton, Dayton, Ohio; Charles W. Spehrley, Jr., White River Junction, Vt.

[73] Assignee: Eastman Kodak Company, Rochester, N.Y.

[21] Appl. No.: 751,655

[22] Filed: Jul. 3, 1985

[51] Int. Cl.[4] ..... B65H 5/20; B65H 9/06

[52] U.S. Cl. ..... 271/246; 271/225; 271/228; 271/902; 101/230

[58] Field of Search ..... 271/245, 246, 902, 186, 271/65, 225, 228; 101/230, 232; 355/3 SH, 14 SH

[56] References Cited

U.S. PATENT DOCUMENTS

| | | | |
|---|---|---|---|
| 3,856,295 | 12/1974 | Looney | 271/65 |
| 4,186,662 | 2/1980 | Borneman | 271/902 |
| 4,223,886 | 9/1980 | Vogt | 271/902 |
| 4,262,895 | 4/1981 | Wenthe, Jr. | 271/902 |
| 4,359,217 | 11/1982 | Roller et al. | 271/186 |
| 4,453,819 | 6/1984 | Wada et al. | 271/902 |
| 4,531,725 | 7/1985 | Seelen | 271/902 |

*Primary Examiner*—Duane A. Reger
*Assistant Examiner*—James E. Barlow
*Attorney, Agent, or Firm*—Warren W. Kurz

[57] ABSTRACT

A document printer includes sheet-feeding apparatus for sequentially presenting both faces of a print-receiving sheet to a print station. According to a preferred embodiment, such apparatus features, as part of the duplex sheet path, reversible sheet-feeding means operable in first or second active modes for selectively feeding sheets into and out of a chute, located upstream from the feeding means, to reverse the sheet's lead edge/trail edge orientation. Such sheet-feeding means is also operable in a passive mode in which it allows sheets to advance, without substantial interference, downstream therepast to a registration position. Control means are provided for switching the feeding means from one of its active modes to its passive mode after a sheet has been advanced into the reversing chute to the extent that the sheet buckles, whereupon the restoring force in the sheet propels the leading edge of the sheet past the feed means and into engagement with a registration gate located at the registration position.

10 Claims, 8 Drawing Figures

SHEET-REGISTRATION AND FEEDING APPARATUS

BACKGROUND OF THE INVENTION

The present invention relates to apparatus for registering and feeding sheet material, e.g., sheets of paper, to a work station, e.g., the print station of a document printer. More particularly, it relates to a sheet registering and feeding apparatus which is particularly useful in a duplex document printer for re-registering and feeding image-receiving sheets to a work station upon having one side thereof previously presented.

Duplex document printers and copiers are well known in the art. See, for example, the printers and copiers disclosed in U.S. Pat. Nos. 4,453,840; 4,348,101; 4,305,655; 4,330,197; and 4,140,387. Virtually all such printers and copiers include sheet-feeding apparatus adapted to sequentially present both faces of a sheet to a work station (e.g., the print station of a printer, or the exposure and transfer stations of an electrophotographic copier).

The presentation of both faces of a sheet to a work station typically involves the steps of (a) inverting the sheet between successive presentations so that, after presenting one face to the work station, the opposite face is in a position for presentation, and (b) reversing the sheet's lead/trail edge orientation, so that both faces of the sheet are advanced in the same direction past the work station. Usually added to these steps is a third step of re-registering the sheet (e.g., to eliminate skew or to time its advance with some other machine activity) prior to being presented to the work station for a second time.

Apparatus for reversing a sheet's lead/trail edge orientation typically comprises means for feeding a sheet into and out of an arcuate guideway or chute having a closed end. Upon advancing the sheet out of the chute in a direction opposite that which it entered the chute, the sheet's trailing edge (as it entered the chute) now becomes the leading edge, and vice versa. The apparatus disclosed in U.S. Pat. No. 4,262,895 is typical of those devices used for reversing a sheet's lead/trail edge orientation. Such apparatus includes a three roller system which functions to advance sheets into and out of the edge-reversing chute. The three rollers are arranged in a stack and cooperate to define input and output nips at the chute entrance. The central roller of the stack is driven in a direction opposite that of its adjacent rollers. Thus, the central roller cooperates with one of its adjacent rollers to feed sheets into the chute, and cooperates with the other adjacent roller to feed sheets out of the chute. Since the distance between the roller's input nip and the chute's closed end is less than the distance between the sheet's lead and trail edge, a sheet fed into the chute will begin to buckle within the chute before the then trailing edge clears the input nip. Ideally, as soon as the trailing edge of the sheet clears the input nip, the restoring forces in the sheet cause such edge to move abruptly to the output nip, whereby the sheet is advanced out of the chute.

While apparatus of the above type functions well in reversing a sheet's lead/trail edge orientation, it will, under certain conditions, introduce an undesired skew into the sheet as it exits from the reversing chute. For example, if the closed end of the chute is not perpendicularly aligned with the feed path, the sheet will tend to skew as it buckles within the chute. Thus, upon becoming free of the roller's input nip, the sheet's trailing edge will snap into the output nip with one side of the edge arriving at the output nip before the other. The result, of course, is that the sheet will be fed from the chute, one side before the other, i.e., in a skewed manner. Also, even when the chute's closed end is perfectly aligned relative to the sheet path, there is a chance that skewing of the sheet will still occur since the roller system actually loses control over the sheet between the time the sheet's trailing edge clears one nip and enters the other. If, for any one of a variety of reasons, one side of the trailing edge of the sheet arrives at the output nip before the other, sheet skew will be introduced.

In the commonly-assigned U.S. Pat. No. 4,223,886, a similar apparatus is disclosed for reversing a sheet's lead/trail edge orientation. In this case, a two-roller system is employed for advancing a sheet into and out of a reversing chute. The rollers are selectively driven in opposite directions to advance sheets into and out of the chute. To effect registration of the sheet as it exits the chute, a registration gate is moveable into and out of the sheet path downstream of the roller pair. In this case, the roller pair advances the sheet into the chute only until the trailing edge of the sheet passes the registration position. At this point, the registration gate is moved into the sheet path and the roller pair is driven in the opposite direction to advance the now leading edge of the sheet into contact with the gate. While control over the sheet is maintained by the roller pair at all times, accurate registration of the sheet against the registration gate relies upon a slipping, frictional engagement between the rollers and the sheet. Since sheet's of different texture give rise to different frictional forces, no single pressure setting can be made which will assure a reliably registered feeding of all type of sheets. In this particular patent, any skew which may be introduced in the sheet as it is fed from the reversing chute is removed further downstream by a registration gate positioned at the work station.

SUMMARY OF THE INVENTION

In view of the foregoing discussion, it may be appreciated that an object of this invention is to provide sheet-registration and feeding apparatus which suffers none of the aforementioned disadvantages. The apparatus of the invention is characterized by sheet-buckling means positioned upstream of a registration position and selectively operable in either (i) an active mode in which it acts to produce a buckle in a sheet located upstream of the registration position by advancing the sheet edge which is closer to the registration position toward the opposite sheet edge while maintaining such opposite sheet edge stationary, or (ii) a passive mode in which it allows a sheet, upon being buckled, to self-propel itself by the restoring forces in the sheet to the registration position. Control means are provided for switching the sheet buckling means between active and passive modes. Preferably, a registration gate is moveable into the sheet path at the registration position to intercept the leading edge of the sheet to provide registration thereof with respect to the sheet path, and guide means are provided for guiding the sheet to the registration gate as it advances under its own force.

The apparatus of the invention is advantageous over the aforementioned patent disclosures in that control over the sheet is maintained at all times, and in that a slipping engagement between some active feeding means and the sheet is not required to advance the sheet to its registration position.

The invention and its various advantages will become more apparent to those skilled in the art from the ensuing detailed description of a preferred embodiment, reference being made to the accompanying drawings.

DETAILED DESCRIPTION OF PREFERRED EMBODIMENTS

Figure 1:
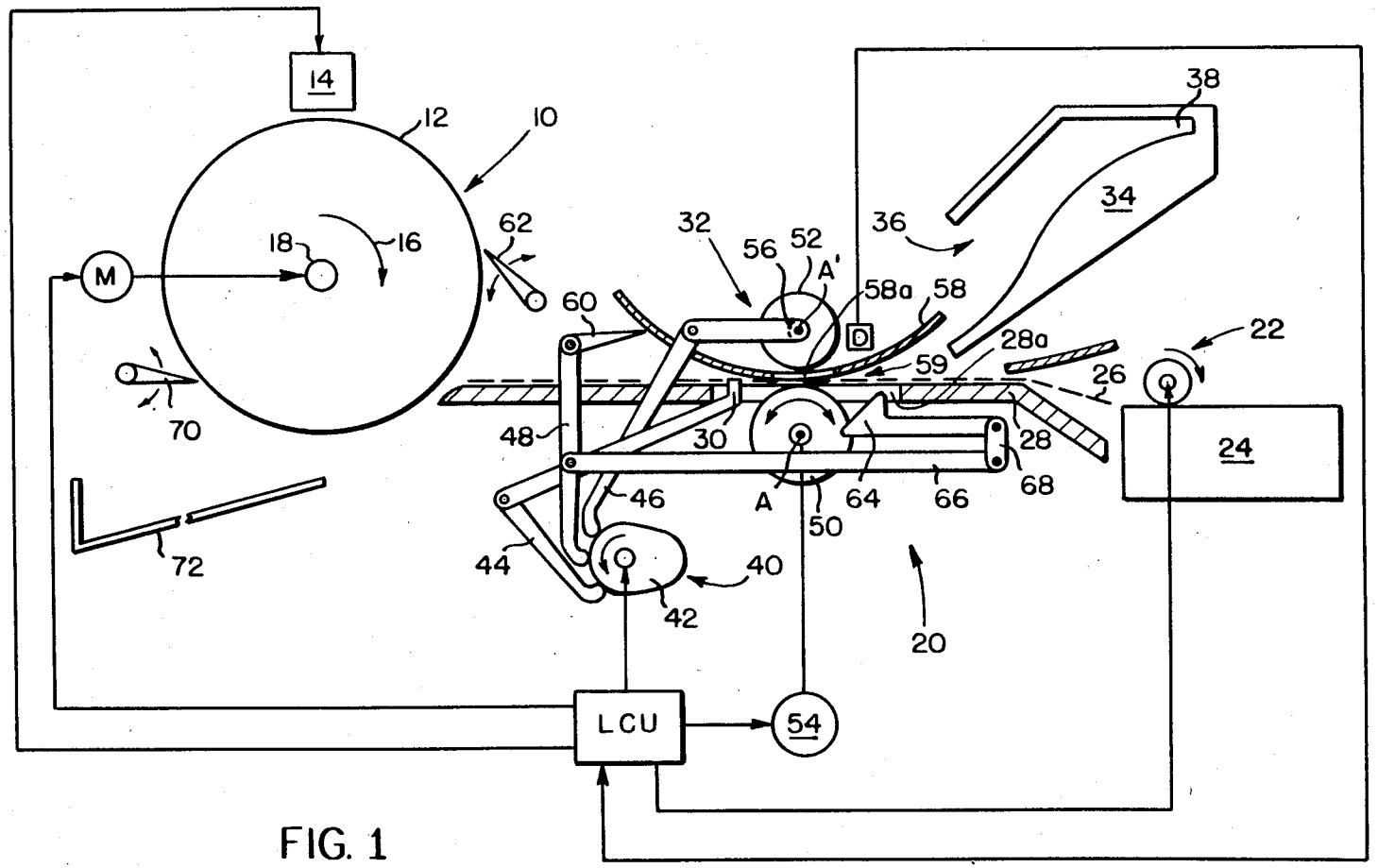
FIG. 1 illustrates a preferred embodiment of the invention as incorporated in an ink jet document printer.

Referring now to the drawings, FIG. 1 illustrates a duplex ink jet printer 10 incorporating a preferred embodiment of the sheet-registration and feeding apparatus of the invention. Printer 10 comprises a vacuum transport drum 12 which serves to transport sheets of paper past an ink jet print station 14. The transport drum and print station are of conventional design and constitute no part of this invention. It suffices to say, therefore, that these system components may be of the type disclosed in U.S. Pat. No. 4,237,466. Drum 12 is rotatably driven in the direction indicated by arrow 16 by a motor M which is operatively connected to the drum's drive shaft 18. As the drum rotates with paper on its surface, the print station is operated under the control of the printer's logic and control unit (LCU) and image information is recorded on that face of the sheet passing directly opposite the print station. Upon recording information on one face of the transported sheet, the sheet is stripped from the drum, reoriented, re-registered and returned to the drum so that printing may be effected on the opposite face thereof. The sheet registration and feeding apparatus 20 for achieving these steps is described below.

Apparatus 20 comprises first feed means 22 for advancing sheets, one at a time, from a sheet supply 24 along a sheet path 26 leading toward the print station. Sheet path 26 is, in part, defined by a flat deck 28 which serves to support the sheets intermediate the sheet supply and the vacuum transport drum. A registration gate 30, located along the sheet path, is provided for registering the sheets moving therealong. Gate 30 is moveable (by means described below) from a position spaced from the sheet path to a registration position in which it intercepts the path and engages the leading edge of a sheet moving toward the transport drum. Second feed means 32 located upstream and in close proximity to the registration gate is selectively operable in one of three modes; i.e., first and second active modes and in a passive mode. In its first active mode, feed means 32 functions to advance sheets, upon being registered by gate 30, to the surface of the vacuum transport drum where they are engaged by the drum and advanced along a sheet inverting path past the print station 14. In its second active mode, the second feed means operates to receive sheets advanced thereto by the vacuum transport drum, and to advance such sheets in an upstream direction, away from the transport drum. In its passive mode, the second feed means allows sheets to advance in a downstream direction without substantial interference.

A chute 34 is positioned upstream of second feed means 32 to receive sheets advanced by the second feed means while operating in its second active mode. Chute 34 has an open end 36 through which sheets advanced by the second feed means enter the chute, and a closed end 38 which, as explained below, serves to arrest forward movement of a sheet within the chute before the trailing edge clears the second feed means. In this manner, the sheet is forced to buckle while positioned in the chute. Timing and control means 40 serves to control the movement of the registration gate and the mode of operation of the second feed means. The timing and control means may comprise for example a cam sequencer 42 and a plurality of cooperating cam-followers 44, 46 and 48 and associated linkages.

As shown in the drawings, second feed means 32 preferably comprises a pair of opposed rollers 50 and 52 which are mounted for rotation about spaced, parallel axes A and A′, respectively. It should be noted that each of these rollers may itself comprise, as is common in the art, a plurality of individual rollers which are spaced apart and mounted for rotation on a common drive shaft. The upper surface of roller 50 protrudes through an aperture **28*a* in deck 28 so that sheets moving along the deck's upper surface contact the roller's surface substantially tangentially. Roller 50 is selectively driven in either clockwise or counterclockwise directions by a bi-directional motor 54 which operates under the control of the printer's logic and control unit (LCU). Roller 52 is an idler roller which is rotatably mounted on a shaft 56. The latter and its associated roller 52 are moveable between a position in which roller 52 contacts roller 50 and cooperates to define a nip for advancing sheets therebetween, and a position in which roller 52 is sufficiently spaced from roller 50 as to allow sheets to advance therebetween with substantially no inerference. The position of roller 52 and the direction of rotation of roller 50 determine the mode of operation of second feed means 32. When the rollers are spaced apart, the second feed means, of course, is in its passive mode; when rollers 50 and 52 engage, the second feed means is in one of its active modes. The mode of operation of the second feed means is controlled by the logic and control unit (LCU), which controls both the cam sequencer 42 and the bi-directional motor 54**. The sheet-registration and feeding apparatus of the invention will be better understood from the ensuing description of its operation, reference being made to FIGS. 2A–2G.

In operation, feed means 22 functions to a feed sheet S from supply 24 along deck 28 toward drum 12. As the sheet advances, the cam sequencer 42 acts through cam followers 44 and 46 to position the registration gate 30 in the sheet path and to switch the second feed means 20 to its passive mode, i.e., to space roller 52 from roller 50. In this condition, the leading edge of sheet S passes freely between the rollers and is guided to the registration gate by the combination of deck 28 and an arcuate guide plate 58 which guides the sheet from above. Deck 28 and guide plate 58 cooperate to define a converging guideway 59 having its narrowest opening in the region between the rollers. Guide plate 58 is provided with an aperture **58*a* through which roller 52 can move into contact with roller 50, as explained below. The arrival of a sheet at gate 30 is sensed by a sheet sensor S (e.g., a photoelectric sensor) which signals the presence of the sheet at the registration gate to the logic and control unit. The latter continues to operate the first feed means 22** until a slight buckle is formed in the sheet, assuring good registration of the leading edge across the entire feed path. (See FIG. 2A).

After a sheet has been advanced from supply 24 and registered by gate 30, second feed means 20 is switched to its first active mode. To do this, cam sequencer 42 acts, through cam follower 46, to move roller 52 through aperture 28*a*, toward engagement with roller 50. (See FIG. 2B). At this time, a sheet is positioned between the rollers, and the rollers now cooperate in engaging the sheet. Shortly thereafter, cam sequencer 42, acting through cam follower 44 removes the registration gate 30 from the sheet path, and the logic and control unit, acting through motor 54, rotates roller 50 in a counterclockwise direction. Operating in its first active mode, the second feed means functions to advance sheets toward vacuum transport drum 14. To prevent the leading edge of a sheet advanced by the second feed means from following guide plate 58, a moveable guide member 60 is provided. Guide member 60 moves between a first position (FIG. 2C) in which it contacts the bottom surface of plate 58 and deflects sheets toward drum 14, and a second position (FIG. 2D) in which it deflects a sheet strip from drum 12 to the downstream side of the drive nip defined by rollers 50 and 52, as explained below. The position of guide member 60 is controlled by the cam sequencer through cam follower 48. (See FIG. 2C).

Figure 2A:
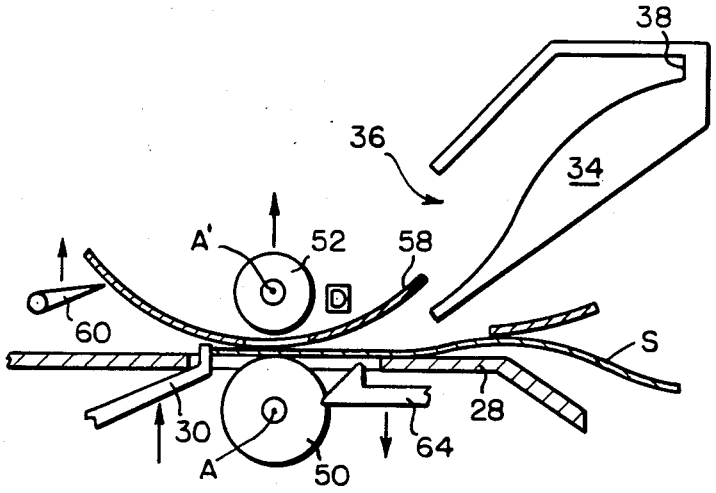
FIGS. 2A–2G illustrate various components of the sheet feeding apparatus of FIG. 1 in different positions during use.
Figure 2B:
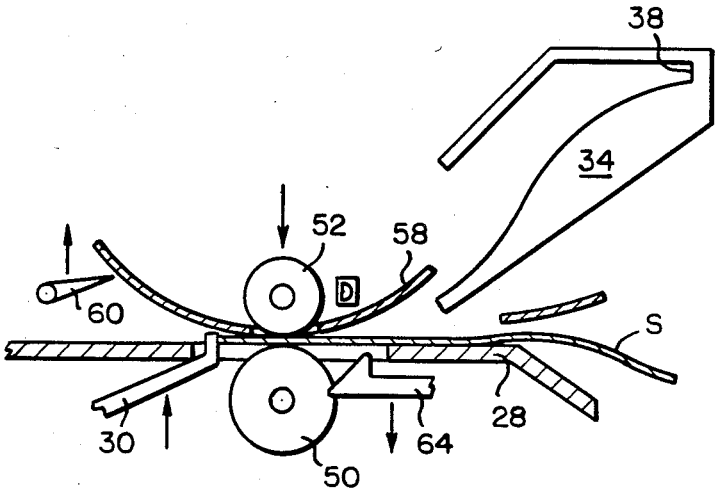
Figure 2C:
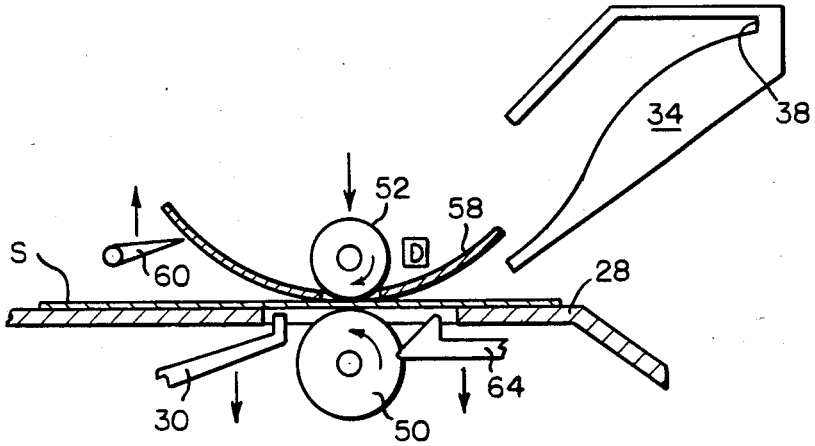
Figure 2D:
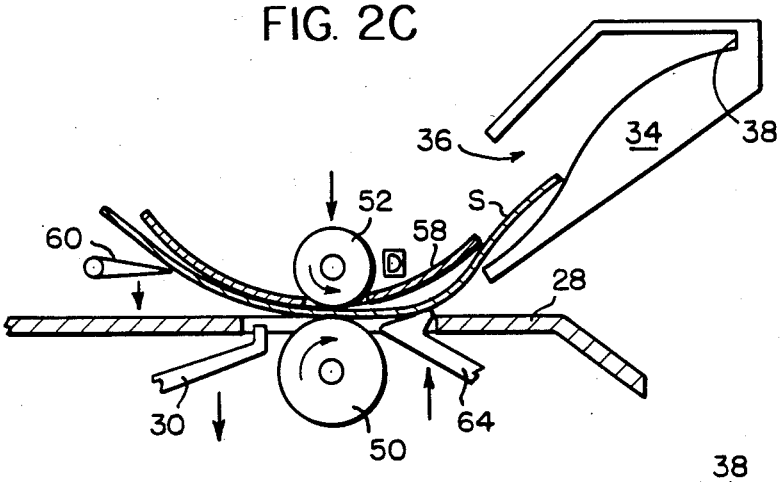
Figure 2E:
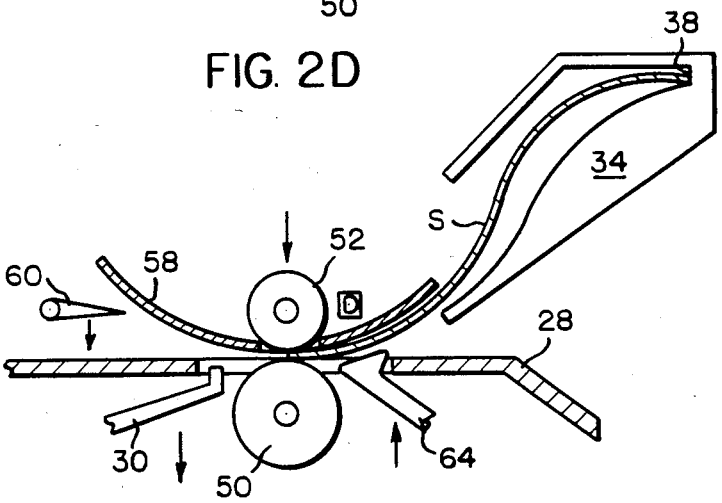
Figure 2F:
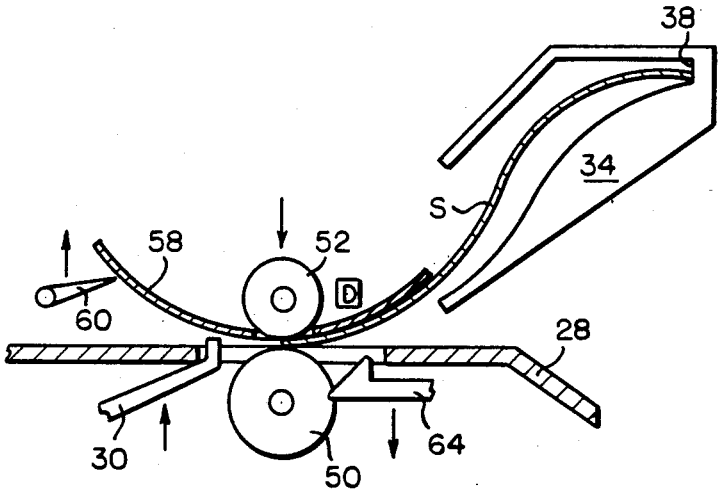
Figure 2G:
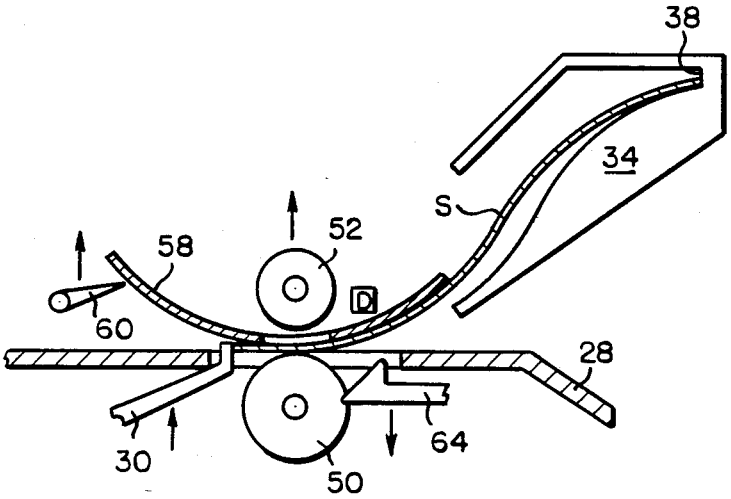

After a sheet has been transported by drum 12 and has received a printed image on one side thereof, a stripper finger 62 is moved to a position in which it acts to strip the leading edge of the sheet from the drum and deflect it upstream toward feed means 32. At this time, guide member 60 is moved, via cam follower 48, to its second position in which it functions to guide the leading edge of the stripped sheet back toward the roller nip. Prior to the arrival of the leading edge at the nip, the direction of roller 50 is reversed and driven in a clockwise direction. Also, prior to the return of the sheet to the roller nip, a second guide member 64 is moved upwardly, through aperture 28*a* in deck 28, to the position as shown in FIG. 2D. The position of second guide member 64 is also controlled by cam follower 48, acting through linkage arms 66 and 68. The function of second guide member 64 is to deflect the sheet's leading edge into chute 34. As the sheet enters chute 34, its presence is sensed by sensor S which signals the logic and control unit to begin to decelerate the rotation of roller 50. Before the trailing edge of the sheet clears the roller nip, the leading edge reaches the chute's closed end 38 where further movement away from the roller nip is arrested. As roller 50 continues rotating at a reduced speed, the sheet's trailing edge moves toward the now stationary leading edge, the result being that the sheet buckles, as shown in FIG. 2E.

After a sheet has been buckled in chute 34 by the second feed means operating in its second active mode, the cam sequencer 42, acting through cam follower 44, returns the registration gate to a position intercepting the feed path. (See FIG. 2F). Thereafter, the cam sequencer, acting through cam follower 46, switches the second feed means to its passive mode, positioning roller 52 in a position spaced from roller 50. At this time, the former trailing edge of the sheet, which is now the leading edge, will be propelled through the space separating the rollers and into engagement with the registration gate. (See FIG. 2G). Preferably, the spacing between the registration position and the closed end of the chute is slightly less than the spacing between the lead and trail edges of the sheet, whereby the sheet remains slightly buckled at the registration gate. Thereafter, the cam sequencer returns the second feed means to its first active mode, moving roller 52 into engagement with roller 50, and the sheet is again returned to the transport drum to receive an image on the opposite face thereof. Upon recording the second image, the duplex process is completed and the sheet is stripped from the drum by a stripper finger 70 which deflects the leading edge into an exit hopper 72.

From the foregoing, it will be appreciated that the sheet-registration and feeding apparatus of the invention overcomes the aforementioned disadvantages of the similar prior art mechanisms. By buckling the sheet in the manner described, i.e., forcing the trailing edge toward the stationary leading edge, and suddenly releasing the tension in the sheet by releasing the trailing edge, the restoring forces in the sheet will propel the sheet to its registration position without contact by any feed elements which might otherwise alter the sheet's course. Note, too, that control over the sheet is always maintained inasmuch as the sheet, during and after the buckling procedure, never leaves the nip between rollers 50 and 52. The apparatus of the invention is also advantageous from the standpoint that the duplex feed path shares the same feeding and guiding elements as the simplex feed path, thereby minimizing path length and cost, and maximizing efficiency.

While the invention has been disclosed with particular reference to a preferred embodiment, it will be apparent to those skilled in the art that modifications may be made without departing from the spirit and scope of the invention, as defined by the following claims.

I claim:

1. Sheet-registration and feeding apparatus for feeding a sheet along a path to a work station, said apparatus comprising:

(a) a means for registering the leading edge of a sheet moving along said path at a registration position;

(b) sheet-buckling means positioned upstream of said registration position and operable in either (i) an active mode in which it acts to produce a buckle in a sheet located upstream of said registration position by advancing the sheet edge which is closer to said registration gate toward the opposite sheet edge while maintaining said opposite sheet edge stationary, or (ii) a passive mode in which it allows a sheet, upon being buckled, to self-propel itself, by the restoring forces in the sheet, along said path to said registration position; and (c) control means for switching said sheet buckling means between active and passive modes.

2. The apparatus as defined by claim 1 wherein said buckling means comprises (a) a pair of opposed rollers mounted for rotation about spaced, parallel axes, the spacing between said axes being selectively changeable between (i) a first spacing in which said rollers cooperate to form a nip for advancing a sheet therebetween, and (ii) a second spacing in which said rollers are spaced apart and allow a sheet to move therebetween without substantial interference, (b) means for selectively driving said rollers in a first direction while their respective axes are at said first spacing, to advance a sheet through the nip in a direction upstream from said registration position, and (c) a chute for receiving a sheet advanced upstream by said rollers, said chute having means for engaging the then leading edge of a sheet advanced into said chute by said rollers, said engaging means being spaced from said nip a distance less than the distance between the leading and trailing edges of a sheet, whereby a sheet buckles in said chute before the then trailing edge of such sheet clears the roller nip; and wherein said control means comprises means for changing the spacing between said roller axes.

3. The apparatus as defined by claim 2 wherein the spacing between said registration position and said engaging means is less than the distance between the leading and trailing edges of a sheet, whereby the sheet upon being propelled from the chute by said restoring forces is still buckled at the time of the then leading edge arrives at said registration position.

4. The apparatus as defined by claim 2 further comprising means for selectively driving said rollers in a second direction opposite said first direction, whereby a sheet, upon being propelled from said chute by said restoring forces and registered by said registration means, can be advanced to said work station by said rollers when their respective axes are spaced at said first spacing.

5. The apparatus as defined in claim 1 wherein said registration means comprises a gate which is selectively movable into and out of said path at said registration position under the control of said control means.

6. Sheet-registration and feeding apparatus for use with a duplex document printer for sequentially presenting both faces of a print-receiving sheet to a print station for printing, said apparatus comprising:

(a) first feed means for advancing a sheet from a sheet supply along a path leading toward said print station;

(b) registration means located along said path for registering sheets moving therealong at a registration position;

(c) second feed means located upstream of and in close proximity to said registration position, said second feed means being operable in either first or second active modes in which said second feed means functions to either advance sheets toward or away from said print station, respectively, or in a passive mode in which it allows sheets to advance therepast in a downstream direction to said registration position;

(d) means defining and inverting transport path extending from said second feed means, past such print station and back to the downstream side of said second feed means for inverting the facial orientation of a sheet moving therealong and returning such sheet to said second feed means;

(e) means for reversing the lead and trail edge orientation of a sheet advanced by said second feed means while operating in its second active mode, said reversing means being located upstream of said registration means and comprising a chute having an open end positioned to receive a sheet advanced by said second feed means while operating in its second active mode, and means for impeding advancement of the sheet within the chute before the then trailing edge of the sheet clears said second feed means, whereby said sheet buckles within said chute, said buckle tending to propel the sheet from the chute toward said registration position; and (f) timing and control means for switching the operation of said second feed means from its second active mode to its passive mode after a sheet buckles in said chute, whereby the sheet advances to the registration position under the restoring forces produced by the buckle in said sheet.

7. The apparatus as defined by claim 6 wherein said second feed means comprises (a) a pair of opposed rollers mounted for rotation about spaced parallel axes, the spacing between said axes being selectively changeable between (i) a first spacing in which said rollers cooperate to form a nip for advancing a sheet therebetween, and (ii) a second spacing in which said rollers are spaced apart and allow a sheet to move therebetween without substantial interference; (b) means for selectively driving said rollers in either of opposite directions while their respective axes are at said first spacing, whereby said rollers cooperate to advance sheets either toward or away from said print station.

8. The apparatus as defined by claim 6 said impeding means comprises stop means position within said chute for engaging the leading edge of a sheet advanced into said chute, said stop means being spaced from said second feed means a distance less than the distance between the lead and trail edges of said sheet.

9. The apparatus as defined by claim 6 wherein said registration means comprises a gate which is moveable into said path at said registration position to the leading edge of sheets moving therealong, and wherein the spacing between said registration position and said second feed means is such that the sheet, as propelled from said chute by said buckle, remains slightly buckled at the time the then leading edge arrives at said registration gate.

10. The apparatus as defined by claim 6 wherein said inverting means comprises a rotatably driven sheet transport drum, said drum being positioned to receive a sheet from said second feed means when operating in said first active mode, and being adapted to transport such sheet along said inverting transport path.

* * * * *